US012128274B2

(12) United States Patent
Rogers et al.

(10) Patent No.: US 12,128,274 B2
(45) Date of Patent: Oct. 29, 2024

(54) ADJUSTABLE PULL-UP BAR

(71) Applicant: RPM Fitness, Inc., Campbell, CA (US)

(72) Inventors: Shane Patrick Rogers, Los Gatos, CA (US); James A. McCrea, San Carlos, CA (US)

(73) Assignee: RPM FITNESS, INC., Campbell, CA (US)

( * ) Notice: Subject to any disclaimer, the term of this patent is extended or adjusted under 35 U.S.C. 154(b) by 0 days.

(21) Appl. No.: 17/457,428

(22) Filed: Dec. 2, 2021

(65) Prior Publication Data

US 2022/0168611 A1 Jun. 2, 2022

Related U.S. Application Data

(60) Provisional application No. 63/120,667, filed on Dec. 2, 2020.

(51) Int. Cl.

| | |
|---|---|
| ***A63B 23/12*** | (2006.01) |
| ***A63B 21/00*** | (2006.01) |
| ***A63B 21/16*** | (2006.01) |

(52) U.S. Cl.

CPC .... *A63B 23/1218* (2013.01); *A63B 21/00047* (2013.01); *A63B 21/169* (2015.10); *A63B 2225/093* (2013.01)

(58) Field of Classification Search

CPC ..... A63B 23/1218; A63B 21/00047; A63B 21/169; A63B 2225/093

See application file for complete search history.

(56) References Cited

U.S. PATENT DOCUMENTS

| | | | | |
|---|---|---|---|---|
| 6,416,447 | B1 * | 7/2002 | Harmon | A63B 23/0355 482/121 |
| 9,333,387 | B2 * | 5/2016 | Hopperstad | A63B 21/00047 |
| 9,427,611 | B1 * | 8/2016 | Balentine | A63B 1/00 |
| 9,452,308 | B2 * | 9/2016 | Lentz | A63B 21/1627 |
| 11,123,595 | B2 * | 9/2021 | Henniger | A63B 21/068 |
| 2015/0290488 | A1 * | 10/2015 | Hopperstad | A63B 17/04 482/38 |
| 2016/0016033 | A1 * | 1/2016 | Schrag | A63B 21/4035 482/129 |
| 2022/0072367 | A1 * | 3/2022 | Wang | A63B 21/4047 |

* cited by examiner

*Primary Examiner* — Loan B Jimenez
*Assistant Examiner* — Andrew M Kobylarz
(74) *Attorney, Agent, or Firm* — SCHWEGMAN LUNDBERG & WOESSNER, P.A.

(57) ABSTRACT

According to an aspect of an embodiment, an adjustable pull-up bar may include a bar, a structural mount, a lever arm, and a control system. The structural mount may be sized and configured to be attached to a stationary object. The lever arm may include a proximal end and a distal end. The proximal end may be coupled to the structural mount. The distal end may be sized and configured to support the bar. The control system may be configured to adjust the height of the bar relative to the ground.

7 Claims, 9 Drawing Sheets

ADJUSTABLE PULL-UP BAR

CROSS-REFERENCE TO RELATED APPLICATION

This application claims the benefit of and priority to U.S. Provisional Patent Application Ser. No. 63/120,667, filed on Dec. 2, 2020, titled "ADJUSTABLE PULL-UP BAR", the disclosure of which is incorporated herein by reference in its entirety.

FIELD

The present disclosure is generally directed towards exercise equipment and, in particular, to an adjustable pull-up bar.

BACKGROUND

Pull-up bars have long been used to perform various fitness exercises. Oftentimes, pull-up bars require a user to lift their entire body weight and may require a user to have sufficient ground clearance to do so.

A pull-up bar is often used for upper body exercise and strength training. A pull-up is a traditional exercise where the body is suspended by the hands and the user pulls his or her body upwardly relative to the pull-up bar. A pull-up, which may also be referred to as a chin-up, may include the user brining the chin over the top of the bar.

Conventional pull-ups can be done with supinated, neutral, or pronated grips (often called "chin-ups," "hammer grip pull-ups," and "pull-ups," respectively). Each hand of the user may use the same grip, or the user may use different grips. The width of the grip may also differ. For example, when grabbing and holding the pull-up bar during the pull-up, the hands can be spaced apart at shoulder-width. The hands may also be spaced apart by a wider or narrower grip, which may make the pull-up harder or easier to complete.

The range of motion for a pull-up can vary. For instance, a pull-up can be conducted with a wide range of motion or a narrow range of motion. This may also make the pull-up easier or more difficult to complete.

Weighted pull-ups may include the user carrying or supporting additional weight, and one arm pull-ups may include the user grasping the pull-up bar with only one hand while pulling up. A one hand pull-up may include one hand grasping the pull-up bar and the other hand grips the other arm just below the wrist. An assisted pull-up is when the user is provided with some assistance while doing a pull-up.

Disadvantageously, traditional pull-up bar may have limited functionality and usefulness. For example, while known pull-up bars may allow a number of different types of pull-ups to be completed, the pull-up bar may have a limited number of other uses. Further, conventional pull-up bars may be difficult to use.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

BRIEF SUMMARY

Pull-up bars may be attached or may be part of exercise apparatuses commonly found in gyms and in at-home exercise equipment. Pull-up bars may also be freestanding platforms. In situations where space may be limited, such as in smaller gyms or home exercise areas, pull-up bars may be configured to have a reduced footprint by attaching to a wall or ceiling. For example, in instances where space is limited, a pull-up bar may be attached to a high point on a wall so as to limit potential interference with other exercise equipment or other useable space. Oftentimes, a pull-up bar is mounted close to a wall or ceiling to save space. This may limit exercises that may be performed on the pull-up bar. For example, a pull-up bar may be mounted so near a wall that the only viable orientation a user may use the pull-up bar is facing the wall. Additionally, the user may be restricted in freedom of movement in the direction of the wall as the wall may be an obstruction.

Pull-up bars may provide benefit to a user by allowing the user to use their own body weight as the resistance. As such, pull-up bars may be mounted at high points on walls or on ceilings so as to improve effectiveness of the apparatus by granting sufficient space to a user to exercise without touching the ground. In some circumstances, a pull-up may be mounted at a high enough position so as to accommodate more users of varying heights. Pull-up bars that are mounted high to accommodate tall users may become difficult for shorter users to use. For example, a pull-up bar mounted high enough that a tall user doesn't touch the ground while hanging may be so tall that a short user is unable to reach the pull-up bar without the help of some other object such as a chair, stool, plyometric box, etc. In some circumstances, a user may need help getting to and/or grabbing onto the pull-up bar. In some cases, a shorter user may need a chair or other object to stand on to grab the pull-up bar. A chair or other object, however, may not be nearby and such an object may not be suitable for standing. In addition, the chair or other object may present a hazard to a user. For instance, the user may stand on a chair or plyometric box so that they can grab the pull-up bar, but the chair or box may now limit the range of motion and/or the type of exercise of the user. Alternatively, or additionally, the chair or box may be located off-center from the pull-up bar so as to not interfere with the user's movement while using the pull-up bar which may introduce hazards to the users. For example, when mounting the pull-up bar from an off-center chair or box, the user may include lateral movement which may cause the user to swing into surrounding objects or which may increase the difficulty in the user maintaining their grip on the pull-up bar. The chair or box may also create a hazard when the user dismounts from the pull-up bar. For example, in instances in which the chair or box is off-center from the pull-up bar, the user may be forced to laterally extend their feet to try and reach the chair or box which may cause the user to lose their balance.

In some circumstances, exemplary embodiments of the adjustable pull-up bar may include an adjustable height pull-up bar. For example, taller users may select a height for the adjustable pull-up bar sufficient for use without touching the ground and shorter users may adjust the adjustable pull-up bar to be a lower height, which may allow the shorter user to perform a similar experience without the need of climbing on potentially dangerous objects.

In an embodiment, an adjustable pull-up bar includes a bar, a structural mount, a lever arm, and a control system. The structural mount is configured to be attached to a stationary object. The lever arm includes a proximal end and a distal end, where the proximal end is coupled to the structural mount, and the distal end is sized and configured to support the bar. The control system is configured to adjust the height of the bar relative to the ground.

Exemplary embodiments of the adjustable pull-up bar may facilitate the performance of additional exercises because the adjustable pull-up bar may provide more space or distance between the adjustable pull-up bar and the wall or ceiling. In addition, the adjustable pull-up bar may be configured to be stowed substantially against the wall or ceiling. Thus, the space saving features of an adjustable pull-up bar may be enhanced by taking up less space when not in use, or at a minimum, preserved by taking up a similar amount of space as a regular pull-up bar.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF EXEMPLARY EMBODIMENTS

The present disclosure is generally directed towards an adjustable pull-up bar. The principles of the present invention, however, are not limited to pull-up bars. It will be understood that, in light of the present disclosure, the adjustable pull-up bar disclosed herein can be successfully used in connection with other types of exercise equipment.

Additionally, to assist in the description of the adjustable pull-up bar, words such as top, bottom, front, rear, right and left are used to describe the accompanying figures. It will be appreciated, however, that the present invention can be located in a variety of desired positions, including various angles, sideways and even upside down.

One or more example aspects of the adjustable pull-up bar may be described below with respect to the figures. In some of the figures, only half of the adjustable pull-up bar and/or components are displayed. One of ordinary skill in the art will understand that the adjustable pull-up bar may have a generally symmetric configuration. For example, the adjustable pull-up bar may be symmetric across a center point of a horizontal bar, which may be displayed in the figures. It will be appreciated, however, that the adjustable pull-up bar may have an asymmetric configuration or other suitable arrangements depending, for example, upon the intended use of the adjustable pull-up bar. Alternatively, or additionally, the adjustable pull-up bar as described with respect to the figures, may include more or less than two adjustable arm elements (e.g., more or less than two structural mounts and/or more or less than two lever arms) for mounting to a wall or ceiling. For example, the adjustable pull-up bar may include three adjustable arm elements, all mounted an equivalent distance from the floor and configured to receive an elongated horizontal bar which may result in a longer adjustable pull-up bar, or a sturdier adjustable pull-up bar when compared to an adjustable pull-up bar with two or less adjustable arm elements. In another example, the adjustable pull-up bar may include one adjustable arm element configured to support a horizontal bar, which may contribute to the adjustable pull-up bar being usable in an area with less available space and/or fewer objects that may support mounting the adjustable pull-up bar.

Figure 1A:
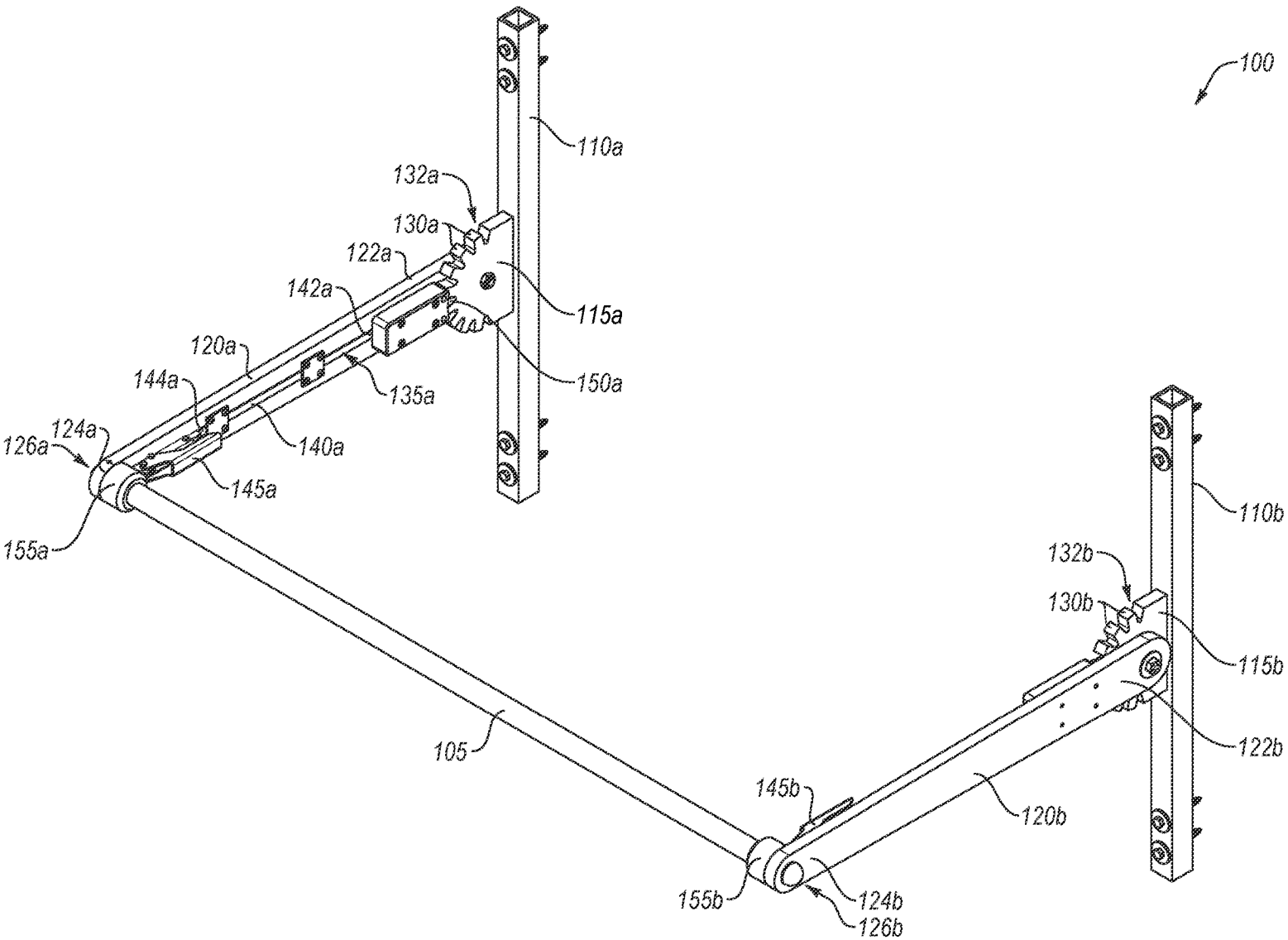
FIG. 1A is a perspective view of an exemplary embodiment of an adjustable pull-up bar.
Figure 2:
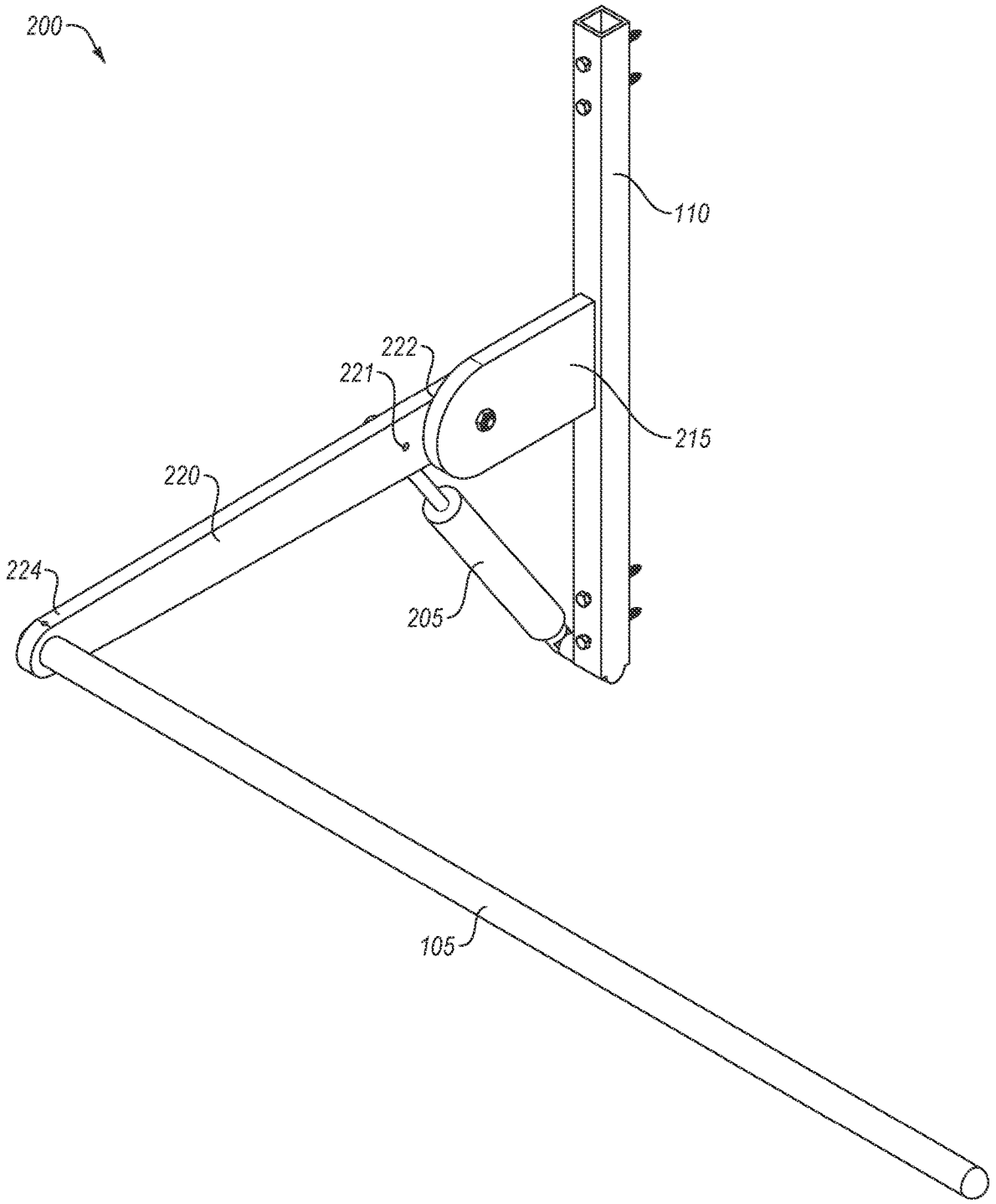
FIG. 2 is a partial perspective view of a portion of an exemplary embodiment of an adjustable pull-up bar.
Figure 3:
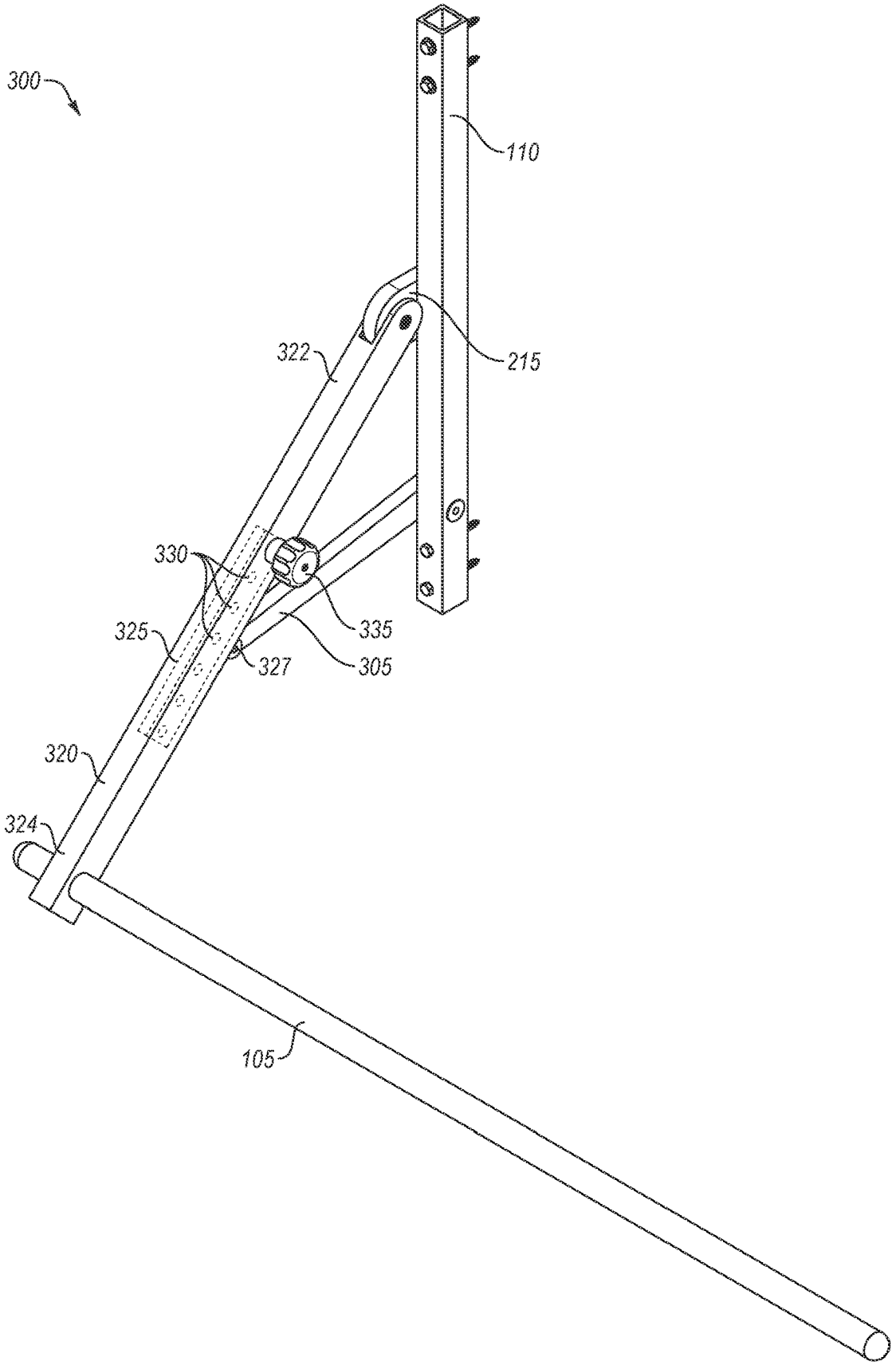
FIG. 3 is a partial perspective view of a portion of an exemplary embodiment of an adjustable pull-up bar.

While various aspects of the adjustable pull-up bar may be described and shown with respect to the figures, it will be appreciated that elements from the figures may be interchanged such that an embodiment may vary with respect to what is shown in the figure. For example, elements of FIG. 1A may be combined with elements of FIG. 2 resulting in an adjustable pull-up bar that is not explicitly shown in the figures, but the elements thereof are shown and described with respect to the other figures. In general, various embodiments of pull-up bar shown in the figures may illustrate differing control systems that may be employed in adjusting and/or maintaining a position of a horizontal bar relative to the ground. For example, FIG. 1A illustrates one or more projections interfacing with and/or engaging one or more recesses, FIG. 2 illustrates an adjustable length angular support, FIG. 3 illustrates a fixed length angular support coupled to a sliding bar, etc. A detailed description of the adjustable pull-up bar now follows.

FIG. 1A is a perspective view of an exemplary embodiment of an adjustable pull-up bar 100, in accordance with at least one embodiment described in the present disclosure. The adjustable pull-up bar 100 may include a horizontal bar 105, a first structural mount 110*a*, a second structural mount 110*b*, a first semicircular support member 115*a*, a second semicircular support member 115*b*, a first lever arm 120*a*, a second lever arm 120*b*, a first proximal end 122*a*, a second proximal end 122*b*, a first distal end 124*a*, a second distal end 124*b*, a first bar aperture 126*a*, a second bar aperture 126*b*, first multiple teeth 130*a*, second multiple teeth 130*b*, a first recess 132*a*, a second recess 132*b*, a first channel 135*a*, a second channel (not illustrated), a first rigid shaft 140*a*, a second rigid shaft (not illustrated), a first proximal shaft end 142*a*, a second proximal shaft end (not illustrated), a first distal shaft end 144*a*, a second distal shaft end (not illustrated), a first locking mechanism 145*a*, a second locking mechanism 145*b*, a first projection 150*a*, a second projection (not illustrated), a first bumper 155*a*, and a second bumper 155*b*. In general, similar elements of the adjustable pull-up bar 100 (e.g., the first structural mount 110*a* and the second structural mount 110*b*) may be collectively referred to as a single element (e.g., the structural mounts 110).

In some embodiments, the semicircular support members 115 may include the multiple teeth 130 disposed around a circular edge of the semicircular support members 115. In some embodiments, the adjustable pull-up bar 100 may include the lever arms 120 that may include the rigid shafts 140 disposed therein. For example, the rigid shafts 140 may be disposed in the channels 135 which may run lengthwise along a medial side of the lever arms 120. In some embodiments, the projections 150 may be configured to engage the recesses 132 that may be disposed between the multiple teeth 130 of the semicircular support members 115. In some embodiments, the semicircular support members 115 may include a shape that may not be semicircular. For example, a hexagonal, an octagonal, a decagonal, and/or other geometric shapes may be used as the semicircular support members 115.

In some embodiments, the adjustable pull-up bar 100 may be configured to be rotatable up to 180 degrees. For example, in a wall mount configuration, the adjustable pull-up bar 100 may be configured to extend substantially upward (away from the ground), substantially downward (toward the ground), and various angles therebetween. In some embodiments, the 180 degrees of rotation in the adjustable pull-up bar 100 may enable a user to store the adjustable pull-up bar 100 in a downward position or an upward position, where the upward position may keep the adjustable pull-up bar 100 out of reach of those that should not use the adjustable pull-up bar 100, such as a child.

In some embodiments, the structural mounts 110 may be configured to attach to a wall or ceiling. As illustrated in FIG. 1A, multiple connectors, such as lag screws, may be used on lateral ends of the structural mounts 110 to attach the structural mounts 110 to a stationary object (e.g., a wall or a ceiling). In some embodiments, the stationary object may be wider than the horizontal bar 105. Alternatively, or additionally, the stationary object may be the same width or narrower than the horizontal bar 105. In some embodiments, different attachment mechanisms may be used. For example, wood screws, concrete lag screws, concrete bolts, various glue-like adhesives, and other suitable attachment mechanisms may be used in conjunction with or in place of the multiple connectors. In some embodiments, the structural mounts 110 may include padding on the surface that is configured to abut the wall or ceiling. For example, the structural mounts 110 may include a thin strip of rubber on the surface that is configured to contact the wall or ceiling such that when attached, the structural mounts 110 may be less likely to damage the wall or ceiling.

In some embodiments, the semicircular support members 115 may include the multiple teeth 130 disposed around the circular edge, which may be similar to a gear. In some embodiments, the first multiple teeth 130*a* and the second multiple teeth 130*b* may include an equivalent number of teeth. Alternatively, or additionally, the first multiple teeth 130*a* may be symmetrically arranged with the second multiple teeth 130*b*. In these and other embodiments, the number of teeth in the multiple teeth 130 may be associated with a discrete number of positions for the adjustable pull-up bar 100 to be located.

The semicircular support members 115 may include elongated sides that may extend the semicircular support members 115 a greater distance beyond the structural mounts 110. For example, the semicircular support members 115 may be similarly shaped to a full radius arch door with a geared half circle edge on one side opposite a flat edge on the other side, and two elongated sides connecting the geared half circle side and the flat edge side.

In some embodiments, the semicircular support members 115 may be constructed of the same materials as the structural mounts 110. For example, structural mounts 110 and the semicircular support members 115 may include steel, iron, and/or similar materials. In some embodiments, the semicircular support members 115 may be welded to the structural mounts 110. Alternatively, or additionally, the semicircular support members 115 may be coupled to the structural mounts 110 using pre-drilled holes, bolts, and nuts, or any other suitable form of attaching two elements together. In these and other embodiments, the semicircular support members 115 may include a joint hole drilled centrally in the semicircular portion of the semicircular support members 115.

In some embodiments, a radius of the semicircular support members 115 may vary which may provide more or less support to the adjustable pull-up bar 100 or which may increase or decrease a number of selectable angles for the adjustable pull-up bar 100. For example, the semicircular support members 115 that may include a smaller radius may provide less support to the adjustable pull-up bar 100 and may include less selectable angles for the adjustable pull-up bar 100. The semicircular support members 115 that may include a larger radius may provide more support to the adjustable pull-up bar 100 and may include more selectable angles for the adjustable pull-up bar 100.

In some embodiments, the lever arms 120 may include a joint hole centrally located on the proximal ends 122. The joint hole may be used to couple the lever arms 120 to the semicircular support members 115. In some embodiments, the lever arms 120 and the semicircular support members 115 may include a bolt configured to pass through the joint holes, which may create hinge-like joints between the lever arms 120 and the semicircular support members 115. In some embodiments, the bolt may include an unthreaded portion that is the thickness of the lever arms 120 and the semicircular support members 115 so as to create a smooth hinge motion during rotation.

In some embodiments, the lever arms 120 that may include the channels 135 running lengthwise down the medial side of the lever arms 120. The channels 135 may be configured to house the rigid shafts 140, and the rigid shafts 140 may include the proximal shaft ends 142 and the distal shaft ends 144. In some embodiments, the proximal shaft ends 142 may be coupled to the projections 150, which may be configured to engage the geared semicircular support members 115.

In some embodiments, the distal shaft ends 144 may be coupled to the locking mechanisms 145. The locking mechanisms 145 are illustrated in greater detail in FIG. 1B and discussed below. In some embodiments, only one of the locking mechanisms 145 may be configured to engage the recesses 132 in supporting the horizontal bar 105 in a position. For example, the first locking mechanism 145*a* may operate the first projection 150*a* to engage the first recess 132*a*, while the second locking mechanism 145*b*, the second projection, and the second recess 132*b* may not be present and/or may not contribute to supporting the horizontal bar 105 in a position.

In some embodiments, the lever arms 120 of the adjustable pull-up bar 100 may include the bar apertures 126, which may be disposed at the distal ends 124. In some embodiments, the bar apertures 126 may be configured to receive and/or secure the horizontal bar 105 as part of the adjustable pull-up bar 100. In some embodiments, the bar apertures 126 may include geometrically shaped apertures (e.g., circular apertures) that may be configured to receive the horizontal bar 105 therethrough. Alternatively, or additionally, the bar apertures 126 may include an open top portion to allow the horizontal bar 105 to be placed and held in the bar apertures 126. In some embodiments, the bar apertures 126 may be configured to support any length horizontal bar 105 that is configured to extend between the first bar aperture 126*a* and the second bar aperture 126*b*. For example, the horizontal bar 105 may be approximately the same width as the distance between the structural mounts 110. In another example, the horizontal bar 105 may be wider than the structural mounts 110 as the horizontal bar 105 may be configured to pass through the bar apertures 126. Alternatively, or additionally, the adjustable pull-up bar 100 may include one structural mount 110, one lever arm 120, and/or one bar aperture 126 in supporting the horizontal bar 105 in a position above the ground. Although generally referred to as a horizontal bar 105, in some embodiments, the bar may not be substantially horizontal. For example, the bar may be higher on one side compared to the opposite side.

In these and other embodiments, the inner surfaces of the bar apertures 126 may be lined with non-slip surfaces. For example, the inner surfaces of the bar apertures 126 may include a low-friction plastic layer such that the horizontal bar 105 may be received through the bar apertures 126 but may hold the horizontal bar 105 in place when a user's body weight applies a downward force. Alternatively, or additionally, the horizontal bar 105 may be configured to lock in place in the bar apertures 126 after being received into an operational position. The horizontal bar 105 may be secured in a fixed position relative to the lever arms 120, such as by a bolt or welding. The horizontal bar 105 may also be movable relative to the lever arms 120, if desired.

In some embodiments, the adjustable pull-up bar 100 may include the bumpers 155 encircling the horizontal bar 105. In some embodiments, the bumpers 155 may be located adjacent to and/or abutting the lever arms 120, such as on the medial side of the lever arms 120. The bumpers 155 may be configured to prevent the user's fingers from being pinched between the horizontal bar 105 and the locking mechanisms 145 in instances when the locking mechanisms 145 change from a closed configuration to an open configuration.

In some embodiments, the junction between the lever arms 120 and the semicircular support members 115 may include friction plates (not illustrated) and/or other structures which may help keep the adjustable pull-up bar 100 in a fixed position until the user intends to adjust the adjustable pull-up bar 100. In some embodiments, the friction plate may be configured to prevent or reduce the rate of free fall of the lever arms 120 and/or the horizontal bar 105 in instances in which the projections 150 are disengaged from the semicircular support members 115. In some embodiments, the projections 150 may not fully retract from the recesses 132 in the semicircular support members 115 and may be configured to act as a detent that may prevent the lever arms 120 and/or the horizontal bar 105 from free fall. Alternatively, or additionally, when configured to act as a detent, the projections 150 may provide an indication to the user that the projections 150 are aligned with the recesses 132 in the semicircular support members 115 and that the lever arms 120 may be in a lockable configuration.

In some embodiments, the projections 150 may be configured to engage the recesses 132 of the semicircular support members 115 when the locking mechanisms 145 are in the closed configuration. In some embodiments, the recesses 132 in the semicircular support members 115 may be configured to fully receive the projections 150, such that the projections 150 abut all sides of the recesses 132. In these and other embodiments, in instances in which the projections 150 are fully received into the recesses 132 of the semicircular support members 115, the play in the lever arms 120 may be substantially reduced or removed.

Figure 1B:
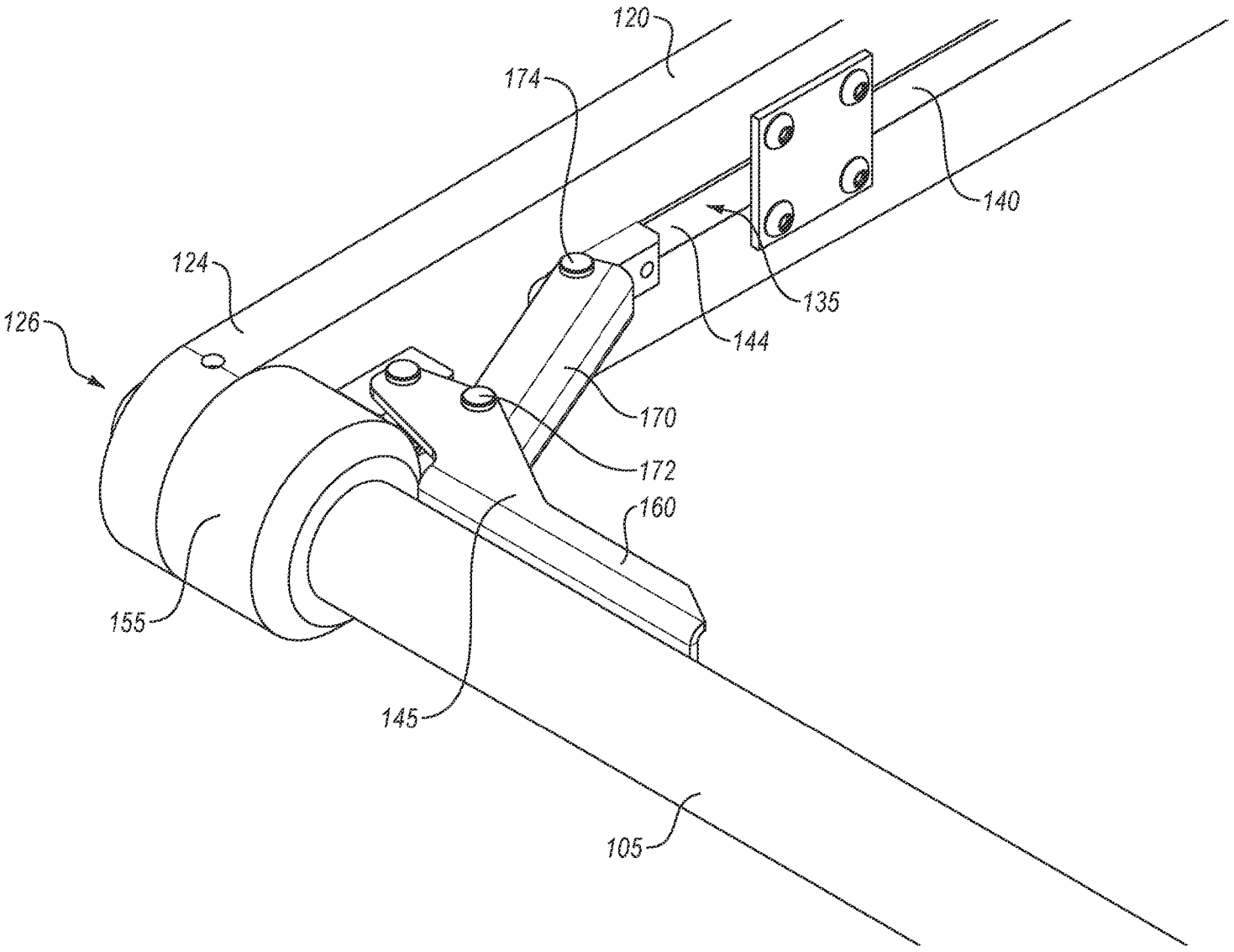
FIG. 1B is an enlarged partial perspective view of a portion of an exemplary embodiment of an adjustable pull-up bar.

FIG. 1B is an enlarged partial perspective view of a portion of an exemplary embodiment of an adjustable pull-up bar, such as the adjustable pull-up bar 100 of FIG. 1A, in accordance with at least one embodiment described in the present disclosure. As illustrated, the portion of the illustrated pull-up bar may include the same or similar elements as the adjustable pull-up bar 100 of FIG. 1A. For example, the horizontal bar 105, the lever arm 120, the distal end 124, the bar aperture 126, the channel 135, the distal shaft end 144, and the locking mechanism 145 may be the same or similar to similarly numbered elements in FIG. 1A. FIG. 1B may provide an enlarged view of the locking mechanism 145, which may include a lever 160 and a shaft connector 170. The shaft connector 170 may include a first hinge 172 and a second hinge 174.

In some embodiments, the locking mechanisms 145 may be configurable between an open configuration and a closed configuration. For example, the locking mechanisms 145 of FIG. 1A are illustrated in a closed configuration and the locking mechanisms 145 of FIG. 1B are illustrated in an open configuration. In these and other embodiments, the locking mechanisms 145 may be coupled to the distal shaft ends 144. In some embodiments, the shaft connector 170 may be configured to hingedly couple to the lever 160 via the first hinge 172. Alternatively, or additionally, the shaft connector 170 may be configured to hingedly couple to the distal shaft end 144 via the second hinge 174.

In the closed configuration, the lever 160 of the locking mechanisms 145 may be substantially parallel to the lever arms 120. Alternatively, or additionally, the shaft connector 170 may be substantially parallel to the lever arms 120 and the shaft connector 170 may be configured to abut the lever arms 120.

In some embodiments, the locking mechanisms 145 may be coupled to the distal shaft ends 144. For example, the shaft connector 170 may be coupled to the distal shaft ends 144. In some embodiments, the lever 160 of the locking mechanisms 145 may be substantially perpendicular to the lever arms 120 and substantially parallel to the horizontal bar 105 in the open configuration. In some embodiments, the lever 160 rotationally opening (e.g., from a closed configuration to an open configuration) may cause the shaft connector 170 to be pulled toward the horizontal bar 105 (e.g., away from the semicircular support members 115) which may result in the projections 150 disengaging from the recesses 132 of the semicircular support member 115. Alternatively, or additionally, as the lever 160 rotates away from the lever arms 120, the shaft connector 170 may be pulled diagonally toward the horizontal bar 105 and may no longer be parallel to the lever arms 120 and/or may no longer abut the lever arms 120. For example, in instances where the locking mechanisms 145 are rotated from a closed configuration to an open configuration, the shaft connector 170 may be pulled in a first direction away from the semicircular support member 115 and in a second direction away from the adjacent lever arm 120, such that there may be an acute angle formed between the shaft connector 170 and the adjacent lever arm 120.

Modifications, additions, or omissions may be made to the adjustable pull-up bar 100 without departing from the scope of the present disclosure. For example, in some embodiments, the adjustable pull-up bar 100 may include a different control system for supporting the horizontal bar 105 in a position (e.g., the lever 160 may be replaced with a different control system). Alternatively, or additionally, in some embodiments, the adjustable pull-up bar 100 may include any number of other components that may not be explicitly illustrated or described.

FIG. 2 is a partial perspective view of a portion of an exemplary embodiment of an adjustable pull-up bar 200, in accordance with at least one embodiment described in the present disclosure. The adjustable pull-up bar 200 may include a horizontal bar 105, a structural mount 110, a semicircular support member 215, an angular support member 205, and a lever arm 220. The lever arm 220 may include a support hole 221, a proximal end 222, and a distal end 224. Like numbered elements between FIG. 1A and FIG. 2 may indicate the same or similar features represented by the elements. For example, the horizontal bar 105 of FIG. 2 may be the same or similar as the horizontal bar 105 of FIG. 1A, and so forth.

In some embodiments, the angular support member 205 may be included in a control system that may be used to adjust the height of the pull-up bar 200 relative to the ground. In some embodiments, the angular support member 205 may include a gas spring. The gas spring may be lockable, and the gas spring may form at least a portion of an angular support member, according to one or more embodiments. In some embodiments, the adjustable pull-up bar 200 may have an identical structure in a wall-mount configuration or a ceiling mount configuration and the adjustable pull-up bar 200 may be retained or connected to the wall or ceiling in a similar manner. For convenience and readability, the elements in at least some of the figures may be discussed in singular form but it should be understood that an adjustable pull-up bar, such as the adjustable pull-up bar 200 may have a symmetric or asymmetric configuration. Thus, in some embodiments, there may be two or more of each element, such as two angular support members 205 (e.g., two gas springs).

In some embodiments, the semicircular support member 215 may be affixed to the structural mount 110. In some embodiments, the semicircular support member 215 may include elongated sides that may extend the semicircular support member 215 a greater distance beyond the structural mount 110. For example, the semicircular support member 215 may be similar to the semicircular support member 215 of FIG. 1A, without the inclusion of the multiple teeth 130 and the recesses 132 disposed about the circular edge. Alternatively, or additionally, the adjustable pull-up bar 200 may not include the semicircular support member 215. For example, the lever arm 220 may be configured to be rotationally coupled to the structural mount 110.

In some embodiments, the support hole 221 may be located between the proximal end 222 and the distal end 224 of the lever arm 220. The support hole 221 may be used to couple the angular support member 205 to the lever arm 220, further discussed below. In some embodiments, the angular support member 205 may include an arm end associated with a side of the angular support member 205 interfacing a lever arm and a structural end associated with a second side of the angular support member 205 interfacing with a structural mount.

In some embodiments, the angular support member 205 may be configured to attach to the structural mount 110 and the lever arm 220. As illustrated, the angular support member 205 may include or consist of a lockable gas spring. In some embodiments, a first end of the angular support member 205 may be affixed at or near one lateral end of the structural mount 110 and a second end of the angular support member 205 may be affixed to the lever arm 220 by way of the support hole 221. In some embodiments, the angular support member 205 may be configured to lengthen and shorten, which may cause the height of the horizontal bar 105 to be adjusted, relative to the ground. For example, when wall mounted in a neutral configuration (e.g., the angular support member 205 is fully retracted), the angular support member 205 may cause the lever arm 220 of an adjustable pull-up bar 200 mounted on a wall to be substantially horizontal, or less than horizontal, depending on a retracted length of the angular support member 205. Further, in instances in which the angular support member 205 is extended, the lever arm 220 may be raised to a position above horizontal, which may result in the horizontal bar 105 having a greater ground clearance, which may make the adjustable pull-up bar 200 more suitable for use for a taller user. Further, in instances in which the angular support member 205 is retracted, the lever arm 220 may be lowered to a position below horizontal, which may result in the horizontal bar 105 having a smaller ground clearance, which may make the adjustable pull-up bar 200 more suitable for use for a shorter user.

In a ceiling mounted variation, the angular support member 205 may operate in a different manner compared to the wall mounted variation. For example, contracting the angular support member 205 may result in the horizontal bar 105 having a greater ground clearance whereas extending the angular support member 205 may result in the horizontal bar 105 having a smaller ground clearance.

FIG. 3 is a partial perspective view of a portion of an exemplary embodiment of an adjustable pull-up bar 300, in accordance with at least one embodiment described in the present disclosure. The adjustable pull-up bar 300 may include a horizontal bar 105, a structural mount 110, a semicircular support member 215, an angular support member 305, a lever arm 320, a sliding component 325, and a locking pin 335. The lever arm 320 may include a proximal end 322 and a distal end 324. The sliding component 325 may include multiple holes 330 and a joint hole 327. Like numbered elements between FIG. 1A and FIG. 3 may indicate the same or similar features represented by the elements. For example, the horizontal bar 105 of FIG. 3 may be the same or similar as the horizontal bar 105 of FIG. 1A, and so forth.

In some embodiments, the angular support member 305 may be similar to the angular support member 205 of FIG. 2 in that the angular support member 305 may be configured to support the horizontal bar 105 in a raised configuration. The angular support member 305 may differ from the angular support member 205 of FIG. 2 in that the angular support member 305 may include a fixed length while the angular support member 205 may include an adjustable length.

In some embodiments, the adjustable pull-up bar 300 may include a structural mount 110 and a semicircular support member 215 that may be the same or similar to those described in relation to FIG. 2. The adjustable pull-up bar 300 may include the lever arm 320 similarly attached to the semicircular support member 215. In some embodiments, the adjustable pull-up bar 300 may not include the semicircular support member 215. For example, the lever arm 320 may be configured to be rotationally coupled to the structural mount 110.

In some embodiments, the lever arm 320 of the adjustable pull-up bar 300 may be cuboidal in shape and may include a hollow interior configured to house the sliding component 325. Alternatively, or additionally, the lever arm 320 may include the locking pin 335 in a fixed location between the proximal end 322 and the distal end 324 of the lever arm 320. In some embodiments, the locking pin 335 may include a pin configured to pass through the lever arm 320 and the locking pin 335 may include a spring configured to apply a force to the pin which may be configured to keep the pin extended through the lever arm 320. In these and other embodiments, the locking pin 335 may be secured in position by turning a head portion of the locking pin 335 until the locking pin 335 securely contacts an outer surface of the lever arm 320. In a secure position, the pin of the locking pin 335 may completely pass through two opposite sides of the lever arm 320. After reviewing this disclosure, it will be appreciated that the lever arm 320 and locking pin 335 could have other suitable shapes, sizes, arrangements, and configurations depending, for example, upon the intended use of the adjustable pull-up bar 300.

In some embodiments, the angular support member 305 may be configured to attach to the structural mount 110 and to the sliding component 325 that may be located within the lever arm 320. In some embodiments, a first end of the angular support member 305 may be affixed at or near one lateral end of the structural mount 110. Alternatively, or additionally, a second end of the angular support member 305 may be affixed to the sliding component 325. In some embodiments, the first end of the angular support member 305 may attach to the structural mount 110 using a rotational hinge, similar to the hinged joint described between the lever arms 120 and the semicircular support members 115 of FIG. 1A. For example, the angular support member 305 may include a joint hole on the first end and the structural mount 110 may include a joint hole at or near one of the lateral ends, and both joint holes may be configured to receive a bolt or rivet or other attachment element that may permit rotation while being attached. Alternatively, or additionally, the second end of the angular support member 305 may include a joint hole configured to attach to a joint hole 327 of the sliding component 325. The second end of the angular support member 305 may be configured to attach to the joint hole of the sliding component 325 using a similar element, such that the joint may provide rotation after attachment.

In some embodiments, the sliding component 325 may include the multiple holes 330, which multiple holes 330 may be equally spaced and may run the length of the sliding component 325. The multiple holes 330 may be sized and configured to accept the pin from the locking pin 335 in a semi-locked configuration. For example, the pin from the locking pin 335 may be spring loaded such that it applies a light force to the sliding component 325 when a hole of the multiple holes 330 is not present for the pin to pass through. In instances in which the sliding component 325 is moved such that a hole of the multiple holes 330 is aligned with the pin of the locking pin 335 that is spring loaded, the spring may cause the pin to pass through a hole of the multiple holes 330 in a first secured configuration. In some embodiments, the locking pin 335 may be screwed into place to further secure the pin passing through a hole of the multiple holes 330 of the sliding component 325, in a second secured configuration.

In some embodiments, the lever arm 320 of an adjustable pull-up bar 300 mounted on a wall may be substantially parallel to the structural mount 110 in a stored configuration. Alternatively, or additionally, in the stored configuration, the sliding component 325 may extend down the lever arm 320 until it contacts, or nearly contacts, the horizontal bar 105 at the distal end 324 of the lever arm 320.

In some embodiments, the lever arm 320 of an adjustable pull-up bar 300 mounted on a wall may be substantially perpendicular to the structural mount 110 in an operational configuration. Alternatively, or additionally, in the operational configuration, the sliding component 325 may extend up the lever arm 320 until it contacts, or nearly contacts, the semicircular support member 215 at the proximal end 322 of the lever arm 320.

Figure 4:
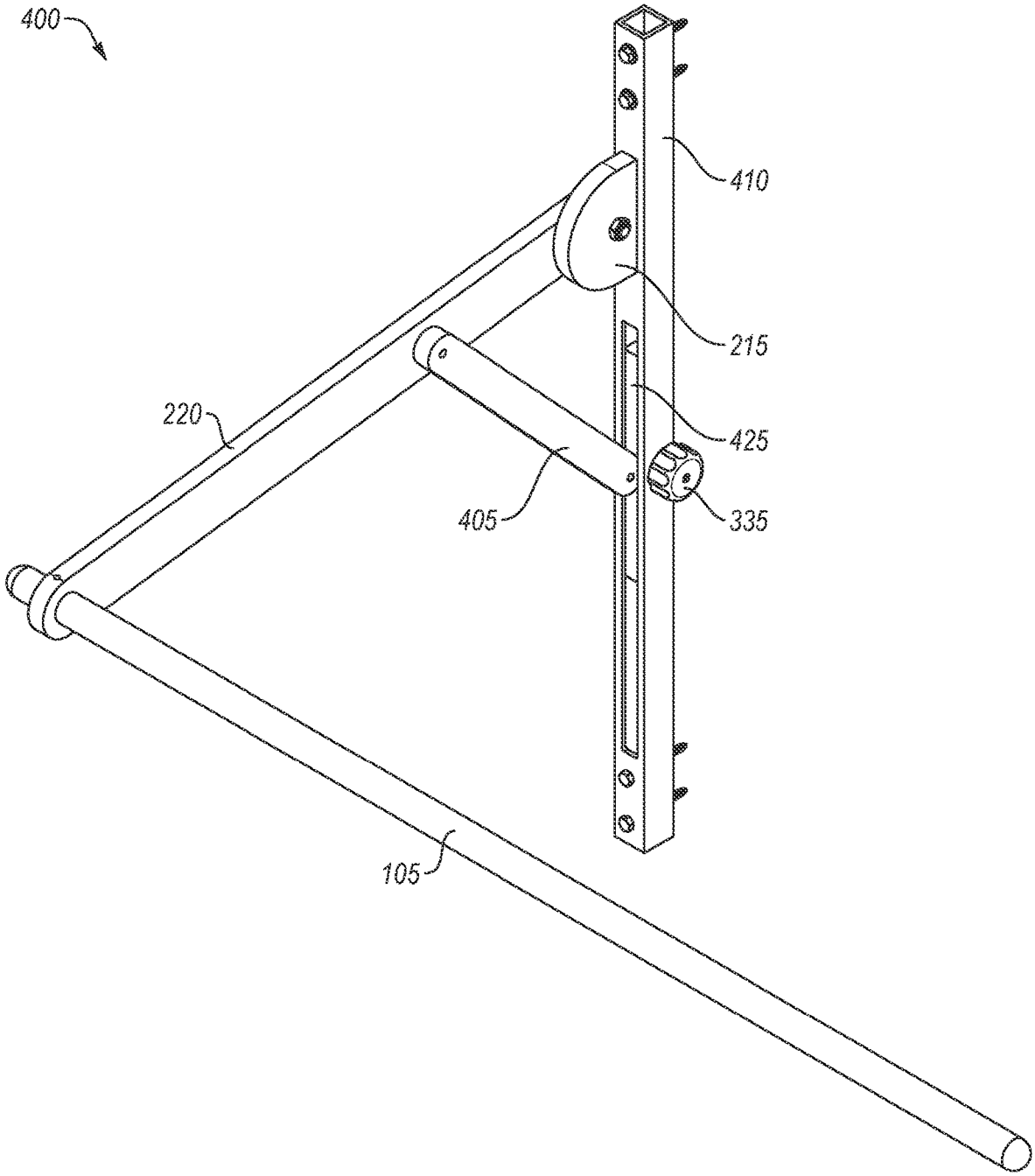
FIG. 4 is a partial perspective view of a portion of an exemplary embodiment of an adjustable pull-up bar.

FIG. 4 is a partial perspective view of a portion of an exemplary embodiment of an adjustable pull-up bar 400 in accordance with at least one embodiment described in the present disclosure. The adjustable pull-up bar 400 may include a horizontal bar 105, a semicircular support member 215, a lever arm 220, a locking pin 335, an angular support member 405, a structural mount 410, a sliding component 425. Like numbered elements between FIGS. 1A, 2, and 3 and FIG. 4 may indicate the same or similar features represented by the elements. For example, the locking pin 335 of FIG. 4 may be the same or similar as the locking pin 335 of FIG. 3, and so forth.

In some embodiments, the adjustable pull-up bar 400 of FIG. 4 may be similar to the adjustable pull-up bar 300 of FIG. 3, where both pull-up bars may include a sliding component attached to structural mounts and the lever arms 220 and 320, respectively. The adjustable pull-up bar 400 of FIG. 4 may differ from the adjustable pull-up bar 300 of FIG. 3 where the sliding component 425 may be disposed within the structural mount 410 of FIG. 4, as opposed to the sliding component 325 that may be disposed within the lever arm 320 of FIG. 3. In some embodiments, the lever arm 220 of FIG. 4 may be the same or similar as the lever arm 220 described relative to FIG. 2. As may be the case with the adjustable pull-up bar 300 of FIG. 3, the adjustable pull-up bar 400 may not include the semicircular support member 215. For example, the lever arm 220 may be configured to be rotationally coupled to the structural mount 410.

Figure 5:
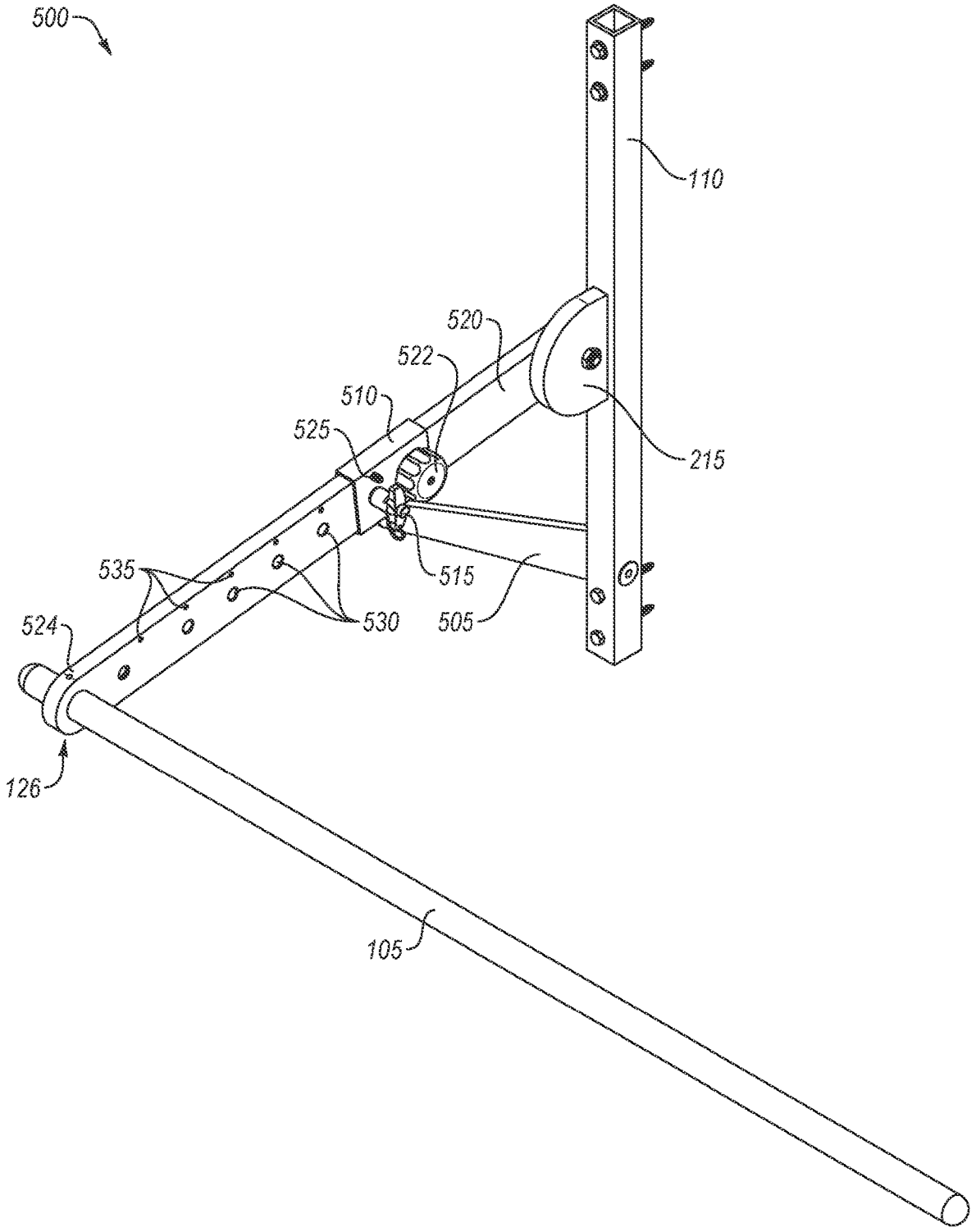
FIG. 5 is a partial perspective view of a portion of an exemplary embodiment of an adjustable pull-up bar.

FIG. 5 is a partial perspective view of a portion of an exemplary embodiment of an adjustable pull-up bar 500, in accordance with at least one embodiment described in the present disclosure. The adjustable pull-up bar 500 may include a horizontal bar 105, a structural mount 110, a semicircular support member 215, an angular support member 505, a sliding sleeve 510, release pin 515, a lever arm 520, a clamping mechanism 522, a detent 525, multiple holes 530, and multiple indentations 535. The lever arm 520 may include a bar aperture 126 and a distal end 524.

In some embodiments, the adjustable pull-up bar 500 may include the structural mount 110 and the semicircular support member 215, which may be the same or similar to identically numbered elements described in relation to FIG. 1A. The adjustable pull-up bar 500 may include the lever arm 520 that may be similar in shape to the lever arm 120 and similarly attached to the semicircular support member 215 as shown in FIG. 2. In some embodiments, the lever arm 520 may include the bar aperture 126 located at the distal end 524 thereof. In some embodiments, the adjustable pull-up bar 500 may not include the semicircular support member 215. For example, the lever arm 520 may be configured to be rotationally coupled to the structural mount 110.

In some embodiments, the lever arm 520 may include multiple holes 530 and the multiple holes 530 may be disposed along the length of the lever arm 520, such as aligned along a center line. In some embodiments, the multiple holes 530 may be equally spaced along the lever arm 520. Alternatively, or additionally, the multiple holes 530 may be spaced such that each hole of the multiple holes 530 represents an equal change in distance from the ground. For example, in instances in which the multiple holes 530 include a first hole, a second hole, and a third hole, changing from the first hole to the second hole and from the second hole to the third hole may result in an equal change of a height between the horizontal bar 105 and the ground level (e.g., each change between holes may result in a one-inch adjustment in height of the horizontal bar relative to the ground level). In some embodiments, the foregoing arrangement of the multiple holes 530 may result in the multiple holes 530 being unequally spaced along the lever arm 520.

In some embodiments, the multiple indentations 535 may be spatially located equally relative to the multiple holes 530 along the lever arm 520. For example, in instances where a first indentation of the multiple indentations 535 is located ten millimeters directly above a hole of the multiple holes 530, all other indentations of the multiple indentations 535 may be located ten millimeters directly above all other holes of the multiple holes 530.

In some embodiments, the angular support member 505 may be configured to attach to the structural mount 110 and to the sliding sleeve 510 on the lever arm 520. The angular support member 505 may be configured to attach to both the structural mount 110 and the sliding sleeve 510 using the same or similar elements as those described in relation to the angular support member 305 as shown and described in FIG. 3.

In some embodiments, the sliding sleeve 510 may be configured to cover all or a portion of the angular support member 505. In some embodiments, the sliding sleeve 510 may include two eyelets arranged such that the angular support member 505 may be disposed between the two eyelets. Alternatively, or additionally, the two eyelets may be similarly sized to a joint hole in the angular support member 505 and may be sized to receive an attachment bolt to create a rotational hinge between the sliding sleeve 510 and the angular support member 505.

In some embodiments, the sliding sleeve 510 may include the release pin 515, the detent 525, and/or the clamping mechanism 522. The release pin 515 may be configured to pass through release pin holes (not illustrated, as the release pin 515 is occupying the release pin holes) located on two of the sides of the sliding sleeve 510. In some embodiments, the release pin 515 may pass through one hole of the multiple holes 530 located on the lever arm 520 when aligned with the release pin holes on the sliding sleeve 510.

In some embodiments, the release pin 515 may be spring loaded such that when the release pin holes align with the multiple holes 530, the release pin 515 may be automatically extended through the release pin holes and the multiple holes 530. Alternatively, or additionally, the release pin 515 may be a solid bolt that a user may manually insert through the release pin holes and the multiple holes 530 in instances in which the release pin holes and the multiple holes 530 are aligned.

Alternatively, or additionally, the release pin 515 may include a bolt with a depressible button on an external surface where the depressible button may control a securing mechanism. In some embodiments, the securing mechanism of the release pin 515 may be disengaged when the depressible button is engaged, and the securing mechanism may be engaged when the depressible button is released. For example, a user may engage the depressible button to retract the securing mechanism which may enable the user to insert the release pin 515 through the release pin holes and the multiple holes 530. Once inserted, the user may release the depressible button which may engage the securing mechanism of the release pin 515, which may secure the release pin 515 in place.

In some embodiments, the sliding sleeve 510 may include the detent 525. The detent 525 may include a spring mechanism which may configure the detent 525 to maintain a light, constant force against the lever arm 520. In some embodiments, the detent 525 may be sized and configured to be received into the multiple indentations 535 located on the lever arm 520. In some embodiments, the detent 525 may provide an indication to the user that the sliding sleeve 510 may be in a position to be secured, such as with the release pin 515. Further, in instances in which the detent 525 engages an indentation of the multiple indentations 535, the detent 525 may provide some resistance to the sliding sleeve 510 potentially moving out of position prior to being secured by the release pin 515.

For example, a user may be sliding the sliding sleeve 510 into place and the detent 525 may engage with an indentation of the multiple indentations 535 which may provide enough resistance to hold the sliding sleeve 510 in place until the user is able to secure the sliding sleeve 510 with the release pin 515. Alternatively, or additionally, in instances in which the detent 525 engages an indentation of the multiple indentations 535 prior to the sliding sleeve 510 reaching the desired location, a user may add some amount of force in the desired direction and the detent 525 may disengage with an indentation of the multiple indentations 535.

In some embodiments, the clamping mechanism 522 may be rotationally adjusted, which may tighten or loosen the clamping mechanism 522, depending on the direction of rotation. The clamping mechanism 522, when tightened, may secure the sliding sleeve 510 to the lever arm 520. In some embodiments, the clamping mechanism 522 may be used in conjunction with the release pin 515 to remove the play remaining in the adjustable pull-up bar 500 after being secured with the release pin 515. For example, in instances in which the user has inserted the release pin 515 in a desired hole of the multiple holes 530, there may be a little or substantial play in the adjustable pull-up bar 500 such that small motions may be noticed. A user may tighten the clamping mechanism 522 which may secure the sliding sleeve 510 to the lever arm 520 which may nearly completely or completely remove the play in the adjustable pull-up bar 500 created by the release pin 515 securing the sliding sleeve 510 to the lever arm 520.

In some embodiments, in a stowed configuration, the lever arm 520 may be substantially parallel to the structural mount 110 and to the structure to which the structural mount 110 is attached.

Figure 6A:
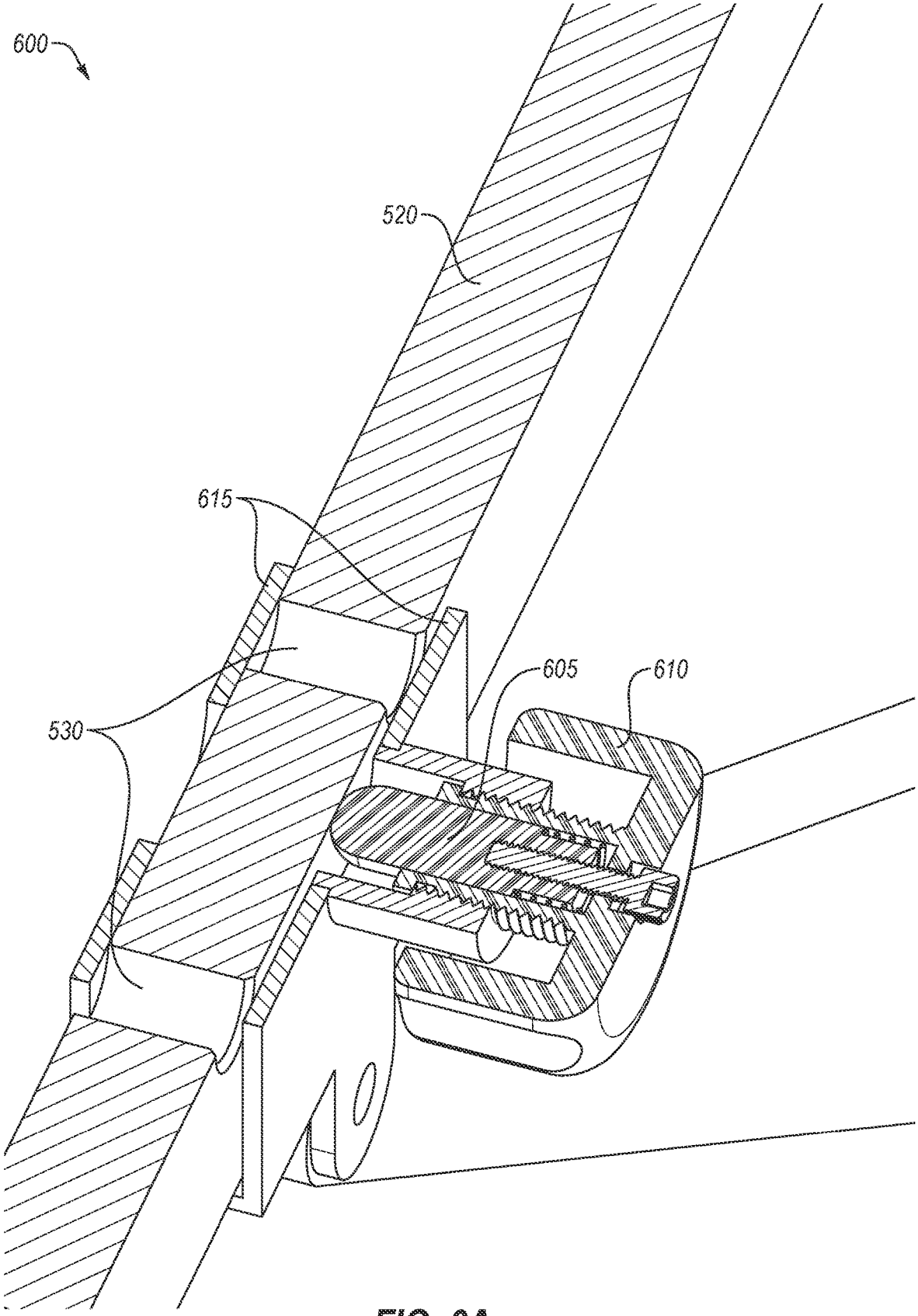
FIGS. 6A-6C are enlarged cut-away views of a clamping mechanism of an exemplary embodiment of an adjustable pull-up bar.
Figure 6B:
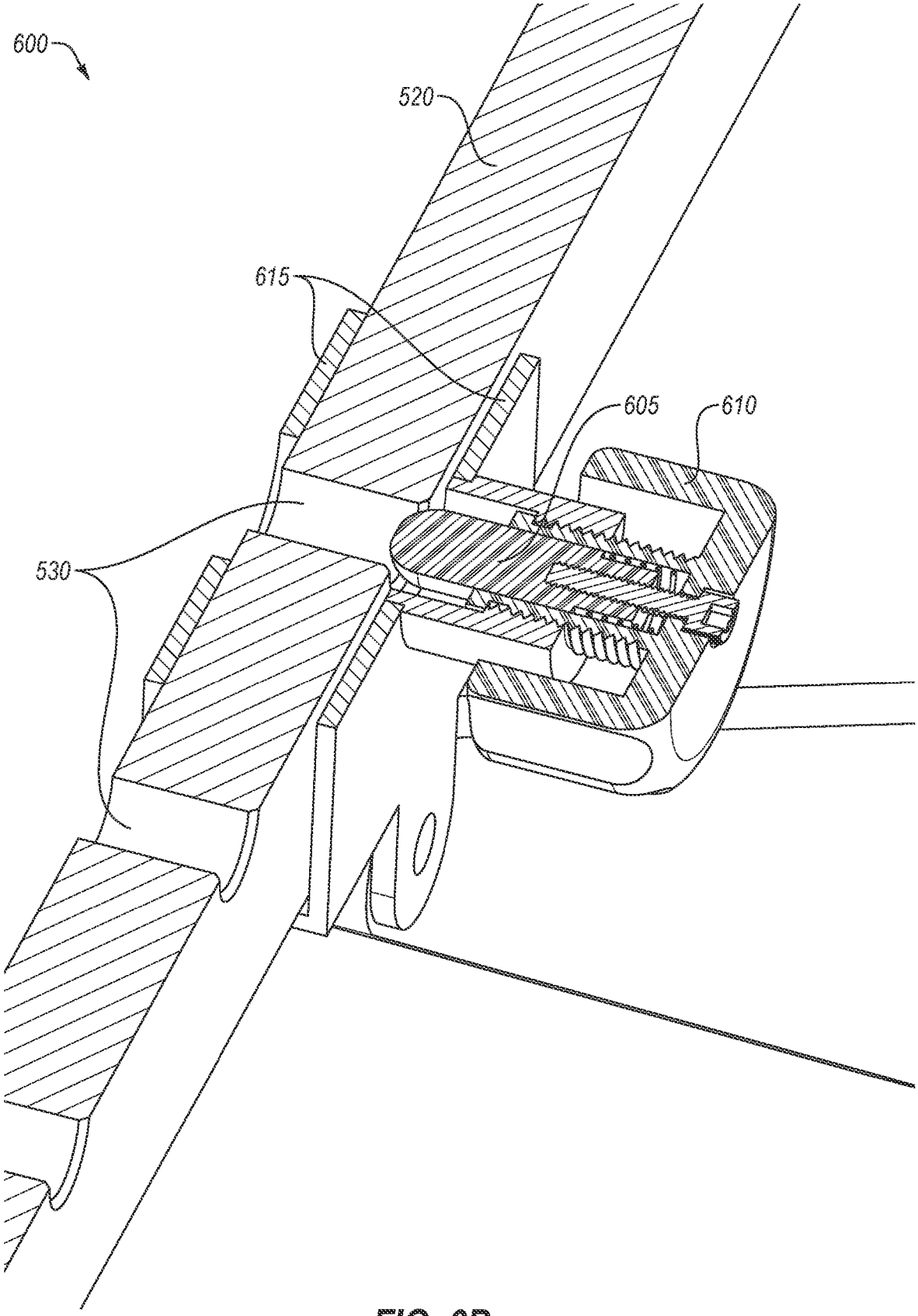
Figure 6C:
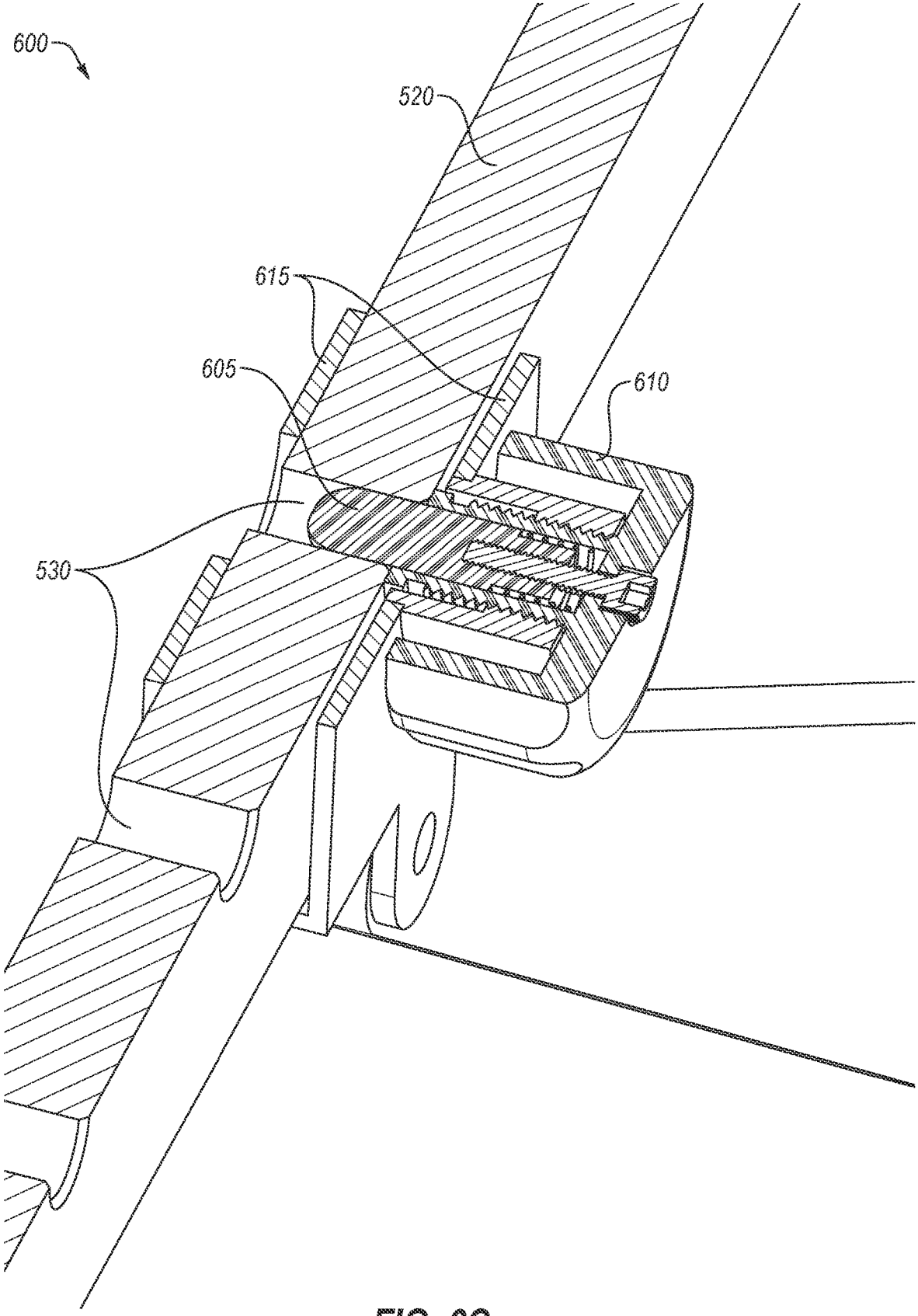

FIGS. 6A, 6B, and 6C are enlarged cut-away views of a clamping mechanism 600 of an exemplary embodiment of an adjustable pull-up bar, in accordance with at least one embodiment described in the present disclosure. The clamping mechanism 600 may include a release pin 605, a tightening mechanism 610, and a sliding sleeve 615.

In some embodiments, the clamping mechanism 600 may be the same or similar to the clamping mechanism 522 of FIG. 5. Alternatively, or additionally, the clamping mechanism 600 may be used in conjunction with one or more elements of the adjustable pull-up bar 500 of FIG. 5. For example, the clamping mechanism 600 may be coupled to a sliding sleeve 510 and/or may be used in conjunction with the release pin 515 and/or the detent 525.

As illustrated in FIGS. 6A, 6B, and 6C, the clamping mechanism 600 may be the only securing mechanism coupled to the sliding sleeve 615 associated with an adjustable pull-up bar, such as the adjustable pull-up bar 500 of FIG. 5. In some embodiments, the clamping mechanism 600 may include elements some or all the elements coupled to the sliding sleeve 510 of FIG. 5, such as the release pin 515, the clamping mechanism 522, and the detent 525. Further, the clamping mechanism 600 may be used in conjunction with other elements of FIG. 5, such as the angular support member 505, the lever arm 520, and/or the multiple holes 530.

FIG. 6A illustrates the release pin 605 of the clamping mechanism 600 in a fully retracted position and not engaged with a hole of the multiple holes 530 in the lever arm 520. In some embodiments, the release pin 605 may include a spring that is configured to maintain a constant force between the release pin 605 and the lever arm 520 in instances in which no hole of the multiple holes 530 is aligned with the release pin 605. The amount of force the spring exerts may be limited so as to not restrict the sliding sleeve 615 from freely sliding along the lever arm 520 in instances in which no hole of the multiple holes 530 is aligned with the release pin 605.

FIG. 6B illustrates the release pin 605 aligned with a hole of the multiple holes 530 in the lever arm 520. Further illustrated, the spring may be configured to extend the release pin 605 to be at least partially disposed in or partially engaging the hole of the multiple holes 530. In some embodiments, the clamping mechanism 600 may provide an indication to a user that the release pin 605 is aligned with a hole of the multiple holes 530 in the lever arm 520. For example, when the release pin 605 of the clamping mechanism 600 transitions from a position unaligned with a hole of the multiple holes 530 to a position aligned with a hole of the multiple holes 530, an audible click sound may be heard by the user. In another example, the clamping mechanism 600 may visually depress a small amount when the release pin 605 aligns with a hole of the multiple holes 530 in the lever arm 520. In another example, the sliding sleeve 615 may transition from a smooth sliding motion to a partially locked position when the release pin 605 aligns with a hole of the multiple holes 530 in the lever arm 520, which may be associated with the release pin 605 being at least partially disposed in or partially engaging the hole of the multiple holes 530 in the lever arm 520.

In some embodiments, the insertion end of the release pin 605 may be rounded. The rounded insertion end of the release pin 605 may enable the release pin 605 to be dislodged from a hole of the multiple holes 530 in the lever arm 520 that yields an undesired height of an adjustable pull-up bar to a user.

FIG. 6C illustrates the clamping mechanism 600 attached to the sliding sleeve 615 and the release pin 605 engaged with a hole of the multiple holes 530 in the lever arm 520. In some embodiments, the release pin 605 of the clamping mechanism 600 may be configured to partially extend through a hole of the multiple holes 530. Alternatively, or additionally, the release pin 605 may be configured to fully extend through a hole of the multiple holes 530.

In some embodiments, the clamping mechanism 600 may extend the release pin 605 as the tightening mechanism 610 is rotated by a user. For example, in instances in which the release pin 605 is aligned with a hole of the multiple holes 530, a user may turn the tightening mechanism 610 to extend the release pin 605 into a hole of the multiple holes 530 in the lever arm 520. In some embodiments, the tightening mechanism 610 may be adjusted until it contacts the lever arm 520. In instances in which the tightening mechanism 610 is rotated until contacting the lever arm 520, the tightening mechanism 610 may apply a force to the lever arm 520 such that any remaining play left in an associated pull-up bar from the release pin 605 in a hole of the multiple holes 530 may be removed. FIG. 6C illustrates a scenario in which the tightening mechanism 610 may be tightened to the point that the tightening mechanism 610 is in contact with the lever arm 520.

Terms used in the present disclosure and in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."This interpretation of the phrase "A or B" is still applicable even though the term "A and/or B" may be used at times to include the possibilities of "A" or "B" or "A and B." All examples and conditional language recited in the present disclosure are intended for pedagogical objects to aid the reader in understanding the present disclosure and the concepts contributed by the inventor to furthering the art, and are to be construed as being without limitation to such specifically recited examples and conditions. Although embodiments of the present disclosure have been described in detail, various changes, substitutions, and alterations could be made hereto without departing from the spirit and scope of the present disclosure. Accordingly, the scope of the invention is intended to be defined only by the claims which follow.

What is claimed is:

1. An adjustable pull-up bar comprising:

a bar;

a structural mount sized and configured to be attached to a stationary object;

a lever arm having a proximal end and a distal end, the proximal end coupled to the structural mount, the distal end sized and configured to support the bar;

a semicircular support member affixed to the structural mount and to the proximal end of the lever arm, wherein a control system further comprises:

a plurality of teeth disposed on a circular edge of the semicircular support member;

a rigid shaft disposed in a channel running lengthwise in the lever arm, the rigid shaft having a proximal shaft end and a distal shaft end positioned opposite the proximal shaft end; and a locking mechanism coupled to the distal shaft end and a projection coupled to the proximal shaft end, wherein in response to the locking mechanism being engaged, the projection engages a first recess of the first plurality of teeth; and the control system configured to adjust a height of the bar relative to a ground.

2. The adjustable pull-up bar of claim 1, wherein the stationary object is at least as wide as the bar.

3. The adjustable pull-up bar of claim 1, further comprising a bar aperture disposed in the distal end, wherein the bar is configured to be received within the bar aperture.

4. The adjustable pull-up bar of claim 1, wherein the plurality of teeth is associated with a number of positions in which the bar may be located.

5. The adjustable pull-up bar of claim 1, wherein the locking mechanism is configured to move the rigid shaft in a first direction when the locking mechanism is engaged, and the locking mechanism is configured to move the rigid shaft in a second direction when the locking mechanism is disengaged.

6. The adjustable pull-up bar of claim 1, further comprising a friction plate disposed between the lever arm and the semicircular support member.

7. The adjustable pull-up bar of claim 1, further comprising one or more bumpers configured to encircle the horizontal bar and adjacent to the lever arm.

* * * * *